US005597087A

United States Patent [19]

Vinarsky

[11] Patent Number: 5,597,087

[45] Date of Patent: Jan. 28, 1997

[54] SPORTS BOTTLE

[76] Inventor: Michael A. Vinarsky, 671 Dover Ct., Elgin, Ill. 60120-7610

[21] Appl. No.: 480,249

[22] Filed: Jul. 7, 1995

[51] Int. Cl.[6] ..... B65D 25/24

[52] U.S. Cl. ..... 220/482; 62/457.3; 215/40; 215/396; 215/399; 224/148.2; D9/523

[58] Field of Search ..... 62/457.3, 457.4; 215/11.1, 399, 40, 396; 224/148.1, 148.7, 269, 414, 148.2; 220/482; D9/523, 531

[56] References Cited

U.S. PATENT DOCUMENTS

| | | | |
|---|---|---|---|
| 3,145,867 | 8/1964 | Roberts et al. | 215/11.1 |
| 3,716,871 | 2/1973 | Borse | 215/399 X |
| 4,981,022 | 1/1991 | Snyder | 62/457.3 |
| 5,044,173 | 9/1991 | Cheng | 62/457.3 X |
| 5,117,993 | 6/1992 | Vesborg | 215/40 |
| 5,289,892 | 3/1993 | Roberts | 62/457.3 X |
| 5,419,154 | 5/1995 | Christoff | 62/457.3 |
| 5,467,877 | 11/1995 | Smith | 62/457.3 X |

*Primary Examiner*—William E. Tapolcai
*Attorney, Agent, or Firm*—Charles F. Lind

[57] ABSTRACT

The disclosed sports bottle has a liquid-tight body with a top wall defining a fill opening that can be closed by a removable cap. The fill opening is angled between 20 and 40 degrees relative to its circumferential wall, allowing nearly complete bottle filling with the bottle tilted, such as when filling from a drinking fountain with low water jet. A downwardly open hook formed off of the body near the its top, in close proximity with the longitudinal axis and laterally spaced from the fill opening, can suspend the bottle in a substantially upright leak-proof orientation, and within reach of an exerciser while on and possibly even using exercise equipment. A thermal chiller pack fits into the bottle interior via a bottom wall opening, being removably sealed as a unit in the bottle. The chiller pack has a solution sealed therein that can be cooled to freezer temperatures without solidifying or leaking from the pack, suited to be sealed to the bottle to keep the bottle liquid chilled for an extended duration.

2 Claims, 1 Drawing Sheet

FIG. 2
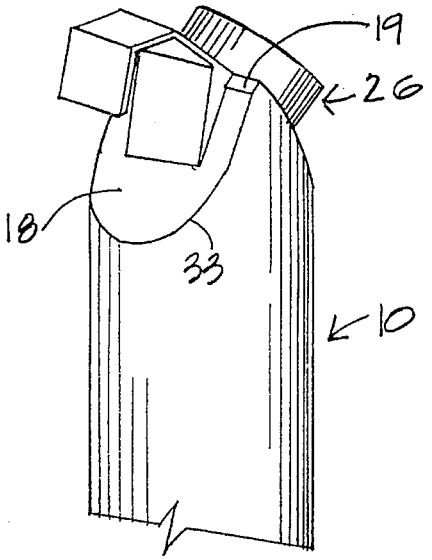
FIG. 1
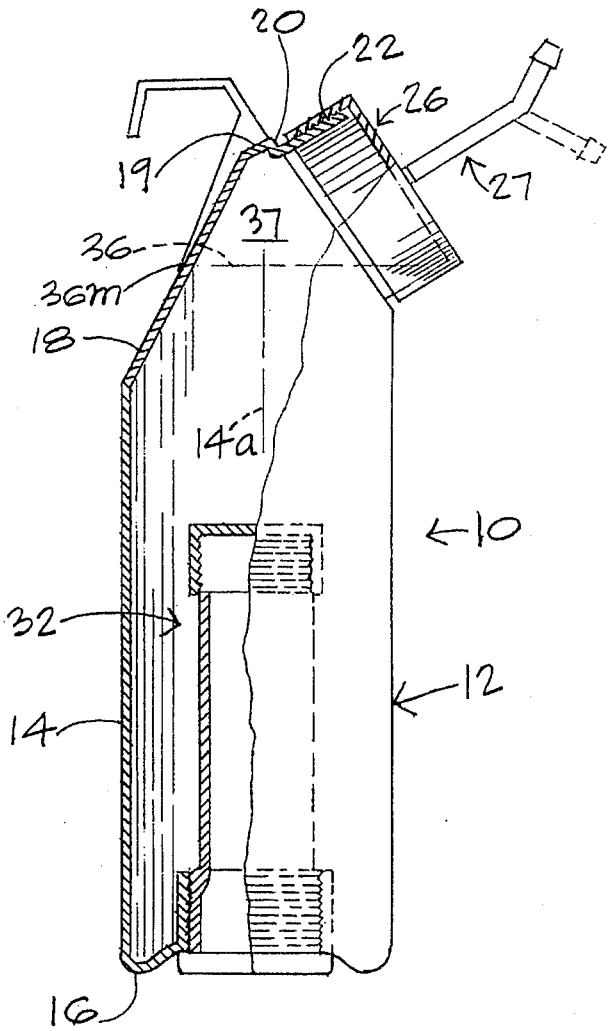
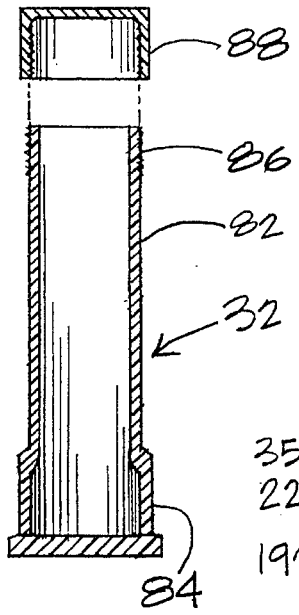
FIG. 3
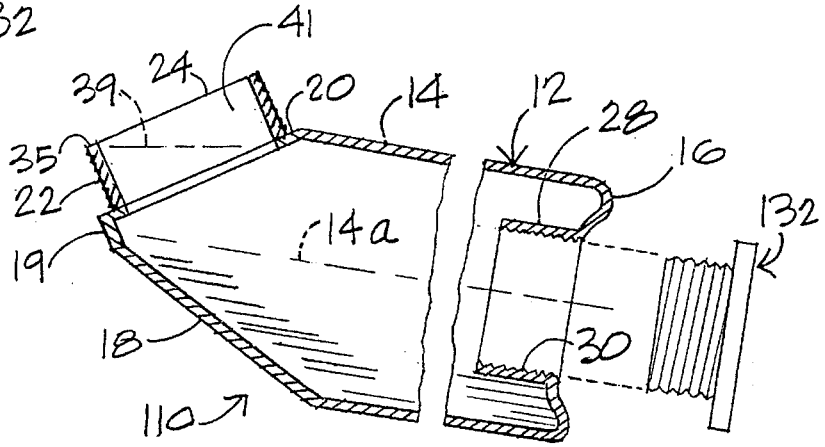
FIG. 4

SPORTS BOTTLE

BACKGROUND OF THE INVENTION

Sports bottles, of the type to which this invention pertains, commonly are of a nonbreakable plastic, with a large fill opening and a screw or snap-on cap for closing the opening, and with straw or squirt outlet means provided through or in the cap. The bottles thus are reasonably durable, reusable with most any liquid drink of choice, economical to make and to purchase, and easy to use in that an exerciser can grip the bottle with one hand and take a drink via the outlet means without spilling even while maintaining some exercise pace.

Many exercisers are interested in workouts of extended durations, at either intense or low levels of efforts. Many exercisers thus have available or even carry individual bottles of water or other liquid, to replenish body liquids lost from sweating. Some exercise routines are for extended non-stop durations on a single specific piece of exercise equipment, such as an exercycle, a treadmill, stair climber, etc.; such pieces of equipment now being common at health clubs and elsewhere. These exercisers particularly might seek to take a drink, while maintaining the same exercise pace.

An observed problem seems to be the difficulty exercisers have in finding a place, within reach while remaining on and operating the exercise equipment, for storing the water bottle when not actually drinking from it.

Another challenge common with the use of conventional sports bottles is filling the bottle from a small sink or a water fountain, which frequently are the only convenient sources of water at the health club or beach, etc. Thus, the water jet height or spacing above the fountain nozzle and drain may be small, as it frequently is; or only limited vertical clearance may exist between a water outlet nozzle and underlying sink structure (neither being shown). This means that the sports bottle must be tilted toward the horizontal in order to bring the bottle fill opening close to the water jet to have any water enter the bottle. Consequently, any severely tilted bottle is likely to be filled then, if at all, to only a small fraction of perhaps even less than half of its capacity.

Also, with indoor health clubs being at room temperatures and warmer than preferred for a refreshing drink, many exercisers add ice to the drink to maintain it cooler. This can require time and effort in fitting the ice cubes individually into the bottle fill opening, and moreover dilutes all drinks other than water as the ice melts.

SUMMARY OF THE INVENTION

This invention relates to sports bottles, and a basis object of this invention is to provide a sports bottle particularly suited to be kept near an exerciser, hooked on exercise equipment in a vertical leak-proof orientation, and nearby so that it can be reached while the exerciser is on and possibly even using the exercise equipment.

Another object of this invention is to provide a sports bottle suited for being easily and more fully filled from varied sources including drinking fountains or small sinks, where the sports bottle can be tilted toward the horizontal for aligning the bottle opening with the water jet from the outlet nozzle, for filling the bottle to complete or near complete capacity.

Still another object of this invention is to provide a sports bottle suited to keep the bottle liquid chilled and below the ambient or room temperature for a duration beyond that provided with conventional sports bottles for yielding a refreshing drink, and further suited to allow quick and easy loading or filling of the bottle and use without deluting the drink caused by melting ice in the drink.

Another basic object of this invention includes providing a sports bottle that can be easily and economically fabricated, for being commercially available for use in the manners noted above.

Features of the inventive sports bottle include having a top fill opening angled relative to the longitudinal axis of the bottle suited to allow the bottle to be substantially filled even when the bottle is tilted toward the horizontal; having a removable thermal chiller suited to be removed for storage and chilling in a freezer before use, operable when needed then to be connected to the bottle for keeping any liquid contained in the bottle chilled for an extended duration, and without diluting the drink caused by melting ice; and having a hook formed on the bottle near its top and close to its longitudional center, to allow the bottle to be suspended from appropriate structure while yet in a non-leaking generally vertical or upright orientation.

My copending application for patent, concurrently filed herewith and having Ser. No. 08/471,911 and entitled Hanger-Clip Accessory for Sports Bottle, discloses an accessory device capable of converting a conventional sports bottle to have the hook feature disclosed herein. The accessory device has a ring structure operable to be fitted over the bottle neck for being coupled to the bottle adjacent the neck and cap thereof, and a downwardly open hook is formed off of the ring structure. A clip is also formed off of the ring structure, for holding a towel or the like to the bottle. The accessory device can be universally coupled to and used on most plastic sports bottles, including the embodiment of FIG. 4 herein, to suspend the bottle in a vertical leak-proof orientation from structures of conventional exercise equipment, with the towel also being held is a sanitary manner off the floor, for easy axcess and use by the exerciser.

BRIEF DESCRIPTION OF THE DRAWINGS

These and other objects, features or advantages of the invention will be more fully understood and appreciated after considerating the following description of the invention, which includes as a part thereof the accompanying drawings, wherein:

FIG. 1 is a side elevational view, partly broken away and in longitudinal center section for clarity of disclosure, of a sports bottle formed according to this invention;

FIG. 2 is a rear perspective view of the sports bottle of FIG. 1, illustrating a hook and adjacent bottle surface;

FIG. 3 is a side elevational view, partly broken away and in longitudinal center section for clarity of disclosure, of a chill pack or chamber to be used with the sports bottle of FIG. 1; and FIG. 4 is a side elevational view, similar to FIG. 1, except of another embodiment of this invention.

DETAILED DESCRIPTION OF PREFERRED EMBODIMENTS OF THE INVENTION

Sports bottles 10 and 110 formed according to the invention are illustrated in FIGS. 1 and 2, and in FIG. 4 respectively. Each bottle has a liquid-tight body 12 comprised of a circumferential side wall 14, a transverse bottom wall 16, and transverse top walls 18, 19 and 20, with the top wall 20 having an upstanding neck 22 surrounding a fill opening 24.

The illustrated neck 22 is externally threaded, to removably accept a threaded cap 26 for closing the fill opening; although a modified neck with a liquid-tight snap-on cap might also be used. Outlet means 27, such as straw or squirt outlet means, provided through or in the cap 26 allows someone (not shown) to take liquid directly from the bottle 10 and into the mouth without removing the cap or spilling, even while exercising.

The circumferential bottle wall 14 can be substantially cylindrical, extended along longitudinal axis 14*a*, and the bottom wall 16 is disposed approximately normal to the circumferential wall and axis, at the bottom of the bottle. An in-turned neck 28 formed off of the bottom wall 16 has internally threaded opening 30. Chiller pack 32 (FIGS. 1 and 3) or plug 132 (FIG. 4) is provided to be threaded into opening 30, to make the bottom body 12 liquid-tight, other than via the fill opening 24.

The transverse top walls 18 and 20 are generally planar, and each is angled from the circumferential wall 14 and axis 14*a*, diverging at their upper ends from one another from opposite sides of the transverse wall 19; while the lower ends and sides of the transverse wall 18 and 20 meet and are rounded along intersection line 33 (FIG. 2 for example) into the circumferential wall 14. The transverse wall 19 is generally near the top of bottle body 12, and longitudinal axis 14*a* is close to extending or extends through the transverse wall 19. The rounded corners between transverse wall 19 and the transverse walls 18 and 20 should be substantially parallel.

The transverse wall 20 is preferably angled from the longitudinal axis 14*a* by approximately 30 degrees, plus or minus 10 degrees for example. The fill opening neck 22 is extended generally normal to the transverse wall 20, is generally cylindrical in shape, and has its open end edge 35 terminating at the fill opening 24 along a plane that is parallel to the transverse wall 20. The fill opening 24 thus is oriented at the same angle as wall 20 relative to the longitudinal axis 14*a*.

When connected to neck 22, cap 26 closes the fill opening 24; while with the cap off (FIG. 4), liquid can be easily directed via the fill opening into the bottle body to fill it. From a practical standpoint, the vertically oriented bottle might be considered completely filled when the horizontal water level plane 36 (FIG. 1) is aligned from the then lowest fill opening edge 35, and circumferential fill mark 36*m* might be provided on the interior surface of the bottle to visually assist one in predetermining the maximum intended water level. Fully filled, air would occupy the space 37 within a vertical bottle above the horizontal water level plane 36.

While the bottle could be filled more by aligning the fill opening edge 35 horizontally, and then capping the bottle; this might represent an overfilled condition, since the bottle neck-cap seal would be subjected continuously to the liquid in a vertical bottle, inviting unintended leakage past this seal.

Of importance, with the bottle fill opening orientation, the bottle can be fully filled with its axis 14*a* being only slightly tilted upwardly from the horizontal, reducing the needed vertical clearance between the lowermost portion of the bottle body and the fill opening, for filling the bottle from fountains or small sinks of the like. For example, the FIG. 4 illustration of the tilted bottle with the horizontal water level plane 39 lined up between the then lower fill opening edge 35 and the lower end of the neck 22 indicates an overfilled condition, since at this fill level, only the space 41 within the bounds of the neck and above the water level plane 39 is void of water.

The improved sports bottle thus can be easily and freely tilted toward the horizontal, to fit between a water outlet nozzle closely space above underlying sink structure (neither being shown), or to align the bottle opening with a laterally directed water jet from the nozzle of a drinking fountain or the like, the water jet being spaced only slightly above the fountain structure itself (not shown).

The invention further provides a hook 46 formed off of the bottle body 12, vertically spaced above the transverse walls 18, 19 and 20. As illustrated, the hook 46 is proximate the extension of the longitudinal axis 14*a* and generally overlies the transverse walls 18 and 19, and is laterally spaced out of the way from the transverse wall 20 and the fill opening 24, cap 26 and outlet means 27.

The hook 46 illustrated has spaced side sections 49 and 51 and an interconnecting section 50, and is open downwardly toward the bottom of the bottle. The side sections 49 and 51 may be spaced apart by approximately one inch at the open hook bottom. The hook 46 should be stiff and strong enough for suspending the coupled sports bottle 10, including its contained liquid.

The hook can be fitted over many component structures (not shown) of conventional exercise equipment, such as a handlebar of an exercycle or a frame rail of a treadmill, which would be convenient for the exerciser to reach even while exercising on the piece of equipment. As suspended, the bottle 10 will be held in a generally vertical stable upright leak-proof orientation.

The hook 46 also can serve as a handle for the exerciser to grip in carrying the sports bottle 12 around as needed.

FIG. 4 illustrates the sports bottle 110 similar in all respects to the bottle of FIG. 1, other than no hook is provided on the bottle. To compensate for this, the accessory device disclosed in my copending application for patent, can be used with this bottle for providing it with the hook feature of FIGS. 1 and 2. The bottle 110 further is illustrated with a plug 132, instead of the thermal chiller pack 32.

The thermal chiller pack 32 of FIGS. 1 and 3 has a liquid-tight body 82 sized to fit into the bottle interior via the bottom wall opening 30, while cylindrical section 84 is sized and externally threaded to cooperate sealingly with the threaded opening 30. The intermediate portion of the body is hollow and has a threaded open end 86 that can be sealed closed with a removable closure cap 88, defining a sealed pack enclosure. The chiller pack enclosure will confine a fluid such as water or water with non-toxic anti-freeze, that can be chilled to freezer temperatures of the order of zero degrees F without expanding to leak from the pack and into the contained bottle liquid.

An alternative chiller pack (not shown) can have the pack body within the bottle interior unitary and closed, reducing the leakage risk that might contaminate the bottle liquid, with the pack body opening being within the enlarged cylindrical section like at 84, to be closed by a threaded plug.

The chiller body might preferably be formed of a highly conductive material, such as aluminum or other metal, to provide for good heat transfer. The plastic bottle body 12 itself will be quite effective in providing a thermal barrier between the bottle liquid and the ambient air, keeping the liquid chilled, or an accessory sleeve of insulating material can be fitted over the bottle body as a thermal barrier.

For effective use, the chiller pack 32 will be stored in a domestic freezer or the like, to chill it to the temperature of the freezer. When needed, it can be removed from the freezer and threaded into the bottom wall opening 30 of the sports bottle 10. Liquid, preferably chilled itself, subsequently added to the sports bottle via fill opening 24 will then be effectively held chilled by the chiller pack 32 over an extended duration of many hours. Even should the pack liquid be heated over time to ambient air temperature, such action will not dilute or otherwise contaminate the drink in the sports bottle.

The sports bottle and thermal chiller are reusable after appropriate cleaning and rechilling of the components. However, these procedures are easy and quick to preform, including placing the pack as a unit in the freezer. The bottom wall 16, even with the thermal chiller pack 32 in place in the bottle, is substantially flat to stably support the bottle vertically when on a flat horizontal surface.

While specific embodiments have been illustrated, it will be obvious that minor changes could be made therefrom without departing from the spirit of the invention. Accordingly, the invention is to be determined by the scope of the following claims.

What is claimed is:

1. A liquid-tight sports bottle, comprising a body having a circumferential wall extended along a longitudinal center axis, and first, second and third transverse walls connected off of the circumferential wall;

the first transverse wall being disposed approximately normal relative to the circumferential wall and near the bottom of the bottle;

the second and third transverse walls being spaced from the first transverse wall and angled upwardly and inwardly from respective lower ends merged directly with the circumferential wall and converging on one another near respective upper ends near the bottle top, and the second and third transverse walls being completely disposed on opposite lateral sides of the longitudinal axis;

a neck projecting from said second transverse wall and defining a liquid fill opening to the bottle, the fill opening being spaced entirely laterally off-set from the longitudinal axis and angled at approximately 30 degrees relative to the longitudinal axis; and a cap for removable connection to the neck for closing the fill opening.

2. A sports bottle according to claim 1, further including a hook formed off of the body and opened downwardly and axially overlying the third transverse wall closely proximate the longitudinal axis and remotely thereof laterally from the fill opening, and said hook being sized to fit over component structures of conventional exercise equipment operable to suspend the bottle in an upright orientation stored within reach of an exerciser on and possibly even using the exercise equipment.

* * * * *